US008773837B2

(12) United States Patent
Partridge et al.

(10) Patent No.: US 8,773,837 B2
(45) Date of Patent: Jul. 8, 2014

(54) MULTI PULSE LINEAR IONIZER

(75) Inventors: Leslie Partridge, San Jose, CA (US); Peter Gefter, South San Francisco, CA (US); Edward Oldynski, Martinez, CA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 13/367,369

(22) Filed: Feb. 6, 2012

(65) Prior Publication Data

US 2012/0224293 A1 Sep. 6, 2012

Related U.S. Application Data

(63) Continuation-in-part of application No. 13/210,267, filed on Aug. 15, 2011, now Pat. No. 8,605,407, which is a continuation of application No. 12/049,350, filed on Mar. 16, 2008, now Pat. No. 8,009,405, said application No. 13/367,369 is a continuation-in-part of application No. 13/023,397, filed on Feb. 8, 2011.

(60) Provisional application No. 60/918,512, filed on Mar. 17, 2007, provisional application No. 61/584,173, filed on Jan. 6, 2012.

(51) Int. Cl.
*H01T 23/00* (2006.01)

(52) U.S. Cl.
CPC ..... *H01T 23/00* (2013.01)
USPC ..... 361/230

(58) Field of Classification Search
USPC ..... 361/230
See application file for complete search history.

(56) References Cited

U.S. PATENT DOCUMENTS

| | | | |
|---|---|---|---|
| 3,875,035 | A | 4/1975 | Lowther |
| 4,138,233 | A | 2/1979 | Masuda |
| 4,417,293 | A | 11/1983 | Larigaldie |
| 4,442,356 | A | 4/1984 | Ludwick et al. |
| 4,689,715 | A | 8/1987 | Halleck et al. |
| 4,781,736 | A | 11/1988 | Cheney et al. |
| 4,878,149 | A | 10/1989 | Stiehl et al. |
| 4,901,194 | A | 2/1990 | Steinman et al. |
| 5,005,101 | A | 4/1991 | Gallagher et al. |
| 5,047,892 | A | 9/1991 | Sakata et al. |
| 5,055,963 | A | 10/1991 | Partridge |
| 5,095,400 | A | 3/1992 | Saito |

(Continued)

FOREIGN PATENT DOCUMENTS

| | | |
|---|---|---|
| EP | 0 386 318 A1 | 9/1990 |
| EP | 0386318 A1 | 9/1990 |

(Continued)

OTHER PUBLICATIONS

Young, Lee; PCT/US08/03488 International Search Report; ISA/US; Jun. 9, 2009, pp. 1-2, US,.

(Continued)

*Primary Examiner* — Dharti Patel
(74) *Attorney, Agent, or Firm* — Uriarte Law

(57) ABSTRACT

An embodiment of the invention provides a method for generating ions within a space separating an emitter and a reference electrode, the method comprising: generating a variable number of small sharp pulses and rate of the pulses depending on the distance of the target from the emitter.

22 Claims, 17 Drawing Sheets

(56) References Cited

U.S. PATENT DOCUMENTS

| | | | | |
|---|---|---|---|---|
| 5,116,583 | A | 5/1992 | Batchelder et al. | |
| 5,249,094 | A | 9/1993 | Hayakawa et al. | |
| 5,388,769 | A | 2/1995 | Rodrigo et al. | |
| 5,447,763 | A | 9/1995 | Gehlke | |
| 5,535,089 | A | 7/1996 | Ford et al. | |
| 5,550,703 | A | 8/1996 | Beyer et al. | |
| 5,630,949 | A | 5/1997 | Lakin | |
| 5,847,917 | A | 12/1998 | Suzuki | |
| 6,145,391 | A | 11/2000 | Pui et al. | |
| 6,330,146 | B1 | 12/2001 | Blitshteyn et al. | |
| 6,504,700 | B1 | 1/2003 | Hahne et al. | |
| 6,636,411 | B1 | 10/2003 | Noll | |
| 6,653,638 | B2 | 11/2003 | Fujii | |
| 6,671,161 | B2 | 12/2003 | Nilsson | |
| 6,693,788 | B1 | 2/2004 | Partridge | |
| 6,807,044 | B1 | 10/2004 | Vernitsky et al. | |
| 6,826,030 | B2 | 11/2004 | Gorczyca et al. | |
| 6,850,403 | B1 | 2/2005 | Gefter et al. | |
| 7,031,133 | B2 | 4/2006 | Riebel et al. | |
| 7,057,130 | B2 | 6/2006 | Gefter et al. | |
| 7,126,092 | B2 | 10/2006 | Lin et al. | |
| 7,177,133 | B2 | 2/2007 | Riskin | |
| 7,180,722 | B2 | 2/2007 | Jacobs et al. | |
| 7,339,778 | B1 | 3/2008 | Gefter et al. | |
| 7,375,944 | B2 | 5/2008 | Izaki et al. | |
| 7,479,615 | B2 | 1/2009 | Gefter et al. | |
| 7,649,728 | B2 | 1/2010 | Fujita et al. | |
| 7,679,026 | B1 | 3/2010 | Gefter et al. | |
| 7,751,695 | B2 | 7/2010 | Decker | |
| 7,821,762 | B2 | 10/2010 | Yasuoka et al. | |
| 7,822,355 | B2 | 10/2010 | Schlitz | |
| 8,009,405 | B2 | 8/2011 | Gefter et al. | |
| 8,038,775 | B2 | 10/2011 | Gefter | |
| 8,048,200 | B2 | 11/2011 | Gefter et al. | |
| 8,063,336 | B2 | 11/2011 | Gefter et al. | |
| 8,174,814 | B2 | 5/2012 | Yasuoka et al. | |
| 2002/0125423 | A1 | 9/2002 | Ebeling et al. | |
| 2003/0007307 | A1 | 1/2003 | Lee et al. | |
| 2003/0011957 | A1 | 1/2003 | Nilsson | |
| 2004/0130271 | A1 | 7/2004 | Sekoguchi et al. | |
| 2005/0052815 | A1 | 3/2005 | Fujiwara et al. | |
| 2005/0083633 | A1 | 4/2005 | Riebel et al. | |
| 2005/0225922 | A1 | 10/2005 | Gefter et al. | |
| 2005/0236375 | A1 | 10/2005 | Gefter et al. | |
| 2006/0018811 | A1* | 1/2006 | Taylor et al. | 422/186.04 |
| 2006/0021508 | A1 | 2/2006 | Kwon et al. | |
| 2006/0071599 | A1 | 4/2006 | Curtis et al. | |
| 2006/0232908 | A1 | 10/2006 | Izumi et al. | |
| 2007/0279829 | A1* | 12/2007 | Gefter et al. | 361/213 |
| 2008/0151465 | A1 | 6/2008 | Fujita et al. | |
| 2008/0199208 | A1 | 8/2008 | Schlitz | |
| 2008/0225460 | A1 | 9/2008 | Gefter et al. | |
| 2008/0232021 | A1 | 9/2008 | Gefter et al. | |
| 2009/0316325 | A1 | 12/2009 | Gefter | |
| 2011/0299214 | A1 | 12/2011 | Gefter et al. | |
| 2012/0200982 | A1 | 8/2012 | Partridge | |
| 2012/0224293 | A1 | 9/2012 | Partridge et al. | |

FOREIGN PATENT DOCUMENTS

| | | | |
|---|---|---|---|
| EP | 0386318 | B1 | 7/1994 |
| EP | 1142455 | | 11/2003 |
| EP | 1 547 693 | A1 | 6/2005 |
| EP | 1 547 693 | B1 | 5/2012 |
| JP | S63-143954 | | 6/1988 |
| JP | 2005-328904 | | 3/1989 |
| JP | H03-230499 | | 3/1989 |
| JP | H0435958 (Y2) | | 8/1992 |
| JP | 5047490 | | 2/1993 |
| JP | H06-275366 | | 9/1994 |
| JP | 7249497 | | 9/1995 |
| JP | 2520311 (B2) | | 7/1996 |
| JP | 10055896 | | 2/1998 |
| JP | H10-156213 | | 6/1998 |
| JP | 11273893 | | 9/1999 |
| JP | 2000-058290 | | 2/2000 |
| JP | 2000-133413 | | 5/2000 |
| JP | 2001-085189 | | 3/2001 |
| JP | 2002-025748 | | 1/2002 |
| JP | 2002216994 | | 9/2002 |
| JP | 3401702 | B2 | 4/2003 |
| JP | 3536560 (B2) | | 6/2004 |
| JP | 2005-216539 | | 8/2005 |
| JP | 2006-12520 | | 1/2006 |
| JP | 2006-196378 | | 7/2006 |
| JP | 2008-124035 | A | 5/2008 |
| JP | 200939893 | | 9/2009 |
| JP | 4465232 | B2 | 5/2010 |
| JP | 5046390 | B2 | 10/2012 |
| JP | I384905 | | 2/2013 |
| TW | 200939893 | | 9/2009 |
| WO | WO 00/38484 | | 6/2000 |
| WO | WO 03100932 | | 12/2003 |
| WO | WO 2013/103368 | A1 | 7/2013 |

OTHER PUBLICATIONS

Office Action mailed Jun. 10, 2010 for U.S. Appl. No. 11/398,446.
International search report, international preliminary report on patentability, and written opinion mailed Jul. 23, 2008 for PCT application PCT/US2007/065767.
Office Action mailed Jan. 28, 2010 for U.S. Appl. No. 11/398,446.
Notice Allowance mailed Oct. 28, 2009 for U.S. Appl. No. 11/623,316.
Office Action mailed Jul. 22, 2009 for U.S. Appl. No. 11/623,316.
Office Action mailed Oct. 30, 2008 for U.S. Appl. No. 11/623,316.
Notice of Allowability mailed Dec. 1, 2005 for U.S. Appl. No. 10/821,773.
Office Action mailed Aug. 11, 2005 for U.S. Appl. No. 10/821,773.
Office Action mailed Mar. 10, 2005 for U.S. Appl. No. 10/821,773.
Notice of Allowability mailed Sep. 22, 2008 for U.S. Appl. No. 11/136,754.
Office Action mailed Apr. 30, 2008 for U.S. Appl. No. 11/136,754.
Office Action mailed Jun. 1, 2007 for U.S. Appl. No. 11/136,754.
Office Action mailed Mar. 28, 2007 for U.S. Appl. No. 11/136,754.
Notice of Allowability mailed Jul. 12, 2011 for U.S. Appl. No. 11/398,446.
Interview Summary mailed Mar. 9, 2011 for U.S. Appl. No. 11/398,446.
Office Action mailed Dec. 13, 2010 for U.S. Appl. No. 11/398,446.
Office Action mailed Mar. 11, 2014 for U.S. Appl. No. 12/456,526.
Office Action mailed Nov. 21, 2012 for U.S. Appl. No. 13/210,267.
Office Action mailed Aug. 3, 2010 for U.S. Appl. No. 12/049,350.
Office Action mailed Jan. 4, 2011 for U.S. Appl. No. 12/049,350.
International Preliminary Report on Patentability and Written Opinion for PCT/US05/09093, Jul. 28, 2005.
International Search Report for PCT/US05/09093, Jul. 28, 2005.
Office Action (Advisory Action) mailed Apr. 11, 2013 for U.S. Appl. No. 13/210,267.
Office Action mailed Jan. 4, 2011 for U.S. Appl. No. 13/023,397.
PCT Application PCT/US2012/033278, Notification of Trans . . . , International Search Report and Written Opinion of the International Searching Authority, mailed Sep. 14, 2012.
PCT/US08/03488 International Search Report; ISA/US; Jun. 9, 2009.
Webpages from LIROS website, pages, date unknown, available online at http://www.liroselectronic.com and http://www.liroselectronic.com/documents/NoStatic-2009_eng.pdf.
Search Report for Taiwan Invention Patent Application No. 101103565, dated Dec. 16, 2013.
Office Action mailed Dec. 7, 2011 for U.S. Appl. No. 12/456,526.
Office Action mailed Jul. 5, 2012 for U.S. Appl. No. 12/456,526.
Applicant-initiated Interview summary mailed Oct. 5, 2012 for U.S. Appl. No. 12/456,526.
Advisory Action mailed Oct. 5, 2012 for U.S. Appl. No. 12/456,526.
Notification of transmittal of the Int'l Search Report and the written opinion of the ISA, & ISR & Written Opinion of ISA (mailed May 7, 2012) for PCT/US2012/024095.

(56) References Cited

OTHER PUBLICATIONS

Notification of Transmittal of the ISR and the Written Opinion (mailed Feb. 19, 2013) for PCT/US2012/064045.
International Search Report and Written Opinion of the ISR (Feb. 19, 2013) for PCT/US2012/064045.
Notification of Transmittal of International Search Report and Written Opinion of the ISA, and International Search Report for PCT/US2008/03488 (Jun. 9, 2009).
International Preliminary Report on Patentability and Written Opinion of the ISA for PCT/US2008/03488 (Jun. 9, 2009).
Written Opinion of the ISA for PCT/US2008/03488 (Jun. 9, 2009).
International Preliminary Report on Patentability and Written Opinion of the ISA for PCT/US2012/024095 (Jul. 5, 2012).
International Search Report for PCT/US2012/024095 (Aug. 16, 2012).
Written Opinion of the ISA for PCT/US2012/024095 (Aug. 13, 2013).
Written Opinion of the ISA (Sep. 17, 2009), and International Search Report (mailed Sep. 25, 2008) for PCT/US2008/057262.
Office Action mailed on Aug. 2, 2012 for U.S. Appl. No. 13/210,267.

* cited by examiner

Multi-Pulse Pulse Definitions
Positive/Bipolar/Negative Modes
(V5)

Phase balance sets % time spent Positive v.s. negative (i.e. 50/50 means equal time in positive phase and negative phase)

WAVEFORMS:

Microprocessor

R1 sets pulse width
R2 sets pulse rate
R3 sets pulse number
R4 sets dead time

Multi Pulse Drive for one or more emitter or parallel emitters

File: Multi Pulse Drive

Multi-Pulse Pulse Definitions
Mode A

Close Distance
Small Swing

Multi-Pulse Pulse Definitions
Mode B

Middle distance
Minimum ionization time

Multi-Pulse Pulse Definitions
Mode A&B

Long distance
Minimum Swing
+ cell particle attraction

Multi-Pulse Pulse Definitions
(V4)

575

Mode A: Alternating (+/-) MicroPulse

Mode B: Many Positive MicroPulses followed by OffTime followed by many Negative MicroPulses Mode A-B: A combination of Modes A and B, where the OffTime of Mode B is filled with Mode A micropulses

| Settable Parameters | Range | Comments |
|---|---|---|
| Ionization Period | 10s-30ms | Ionization Period = Positive On Time(Tp)+ Negative OnTime(Tn) + OffTime(To) |
| ON Time | 10%-100% Ionization Period | Ionization Period= OnTime + OffTime(To) where OnTime is always= Positive OnTime(Tp) + Negative OnTime(Tn) |
| Balance | 5/95%-95/5% of On Time | Positive OnTime(Tp) + Negative OnTime(Tn) Is a Constant. Balance is then a ratio of Tp to Tn |
| Positive Ionization Pulse Width | 10 to 30us (0.25us res) | Applies to Mode B and Mode A-B |
| Negative Ionization Pulse Width | 10 to 30us (0.25us res) | Applies to Mode B and Mode A-B |
| Positive MicroPulse Pulse Width | 10 to 30us (0.25us res) | Applies to Mode A and Mode A-B |
| Negative MicroPulse Pulse Width | 10 to 30us (0.25us res) | Applies to Mode A and Mode A-B |
| Positive Ionization Pulse Period | 0.1s-1ms | Applies to Mode B and Mode A-B |
| Negative Ionization Pulse Period | 0.1s-1ms | Applies to Mode B and Mode A-B |
| Micro Pulse Period | 0.1s-1ms | Applies to Mode A and Mode A-B |

FIG. 5E

Mode A

Mode B

Mode A+B

MULTI PULSE LINEAR IONIZER

CROSS-REFERENCE TO RELATED APPLICATIONS

This application is a continuation-in-part of U.S. application Ser. No. 13/210,267, filed 15 Aug. 2011 now U.S. Pat. No. 8,605,407, which is a continuation of U.S. application Ser. No. 12/049,350, filed 16 Mar. 2008 and issued as U.S. Pat. No. 8,009,405, which claims the benefit of and priority to U.S. Provisional Application No. 60/918,512, filed 17 Mar. 2007.

This application also claims the benefit of and priority to U.S. Provisional Application No. 61/584,173, filed 6 Jan. 2012.

This Application is also a continuation-in-part of U.S. application Ser. No. 13/023,397, filed 8 Feb. 2011.

Applications Ser. Nos. 13/210,267, 12/049,350, 60/918,512, 61/584,173, and 13/023,397 are hereby incorporated herein by reference.

BACKGROUND OF THE INVENTION

1. Field of the Invention

This invention relates to AC corona ionizers for both positive and negative static charges neutralization. More particularly, this invention is relates to AC corona ionizers with a relatively low byproduct emission, such as, ozone, nitrogen oxides and the like, and that achieves a low rate of ion emitter contamination.

2. Background Art

AC corona ionizers are commonly used for static charge neutralization of charged objects. It is known in the art that AC corona ionizers include the features of, for example, a relatively simple design, high reliability, and low cost. These features are particularly true for AC ionizers using a single ion emitter configured as a line thin wire(s) or line of pointed electrodes. However, these ionizers are prone to a relatively high ozone emission and higher rate of electrode contamination by collecting debris from the surrounding air. Electrode contamination decreases the ionization efficiency and may affect ion balance.

Accordingly, a need exists for a solution for static charge neutralization that has a relatively low rate of emitter contamination, a relatively low ozone emission, and/or a combination of the foregoing.

SUMMARY

An embodiment of the invention provides an air/gas ionizing apparatus and method that produce both positive and negative ions for reducing electrostatic charges on various objects. Embodiments of the invention may achieve one or more of the following possible advantages:

(1) Providing a sufficient level of plus and minus ion currents while limiting the ozone and other corona byproducts emission(s);

(2) Reducing the buildup of particles on the emitter points or wire electrodes and minimizing the contamination associated with corona discharge particle emission from the ionizing bar;

(3) Automatically maintaining a reasonably close to zero ions stream balance; and/or (4) Providing a design of a low cost power supply and low maintenance ions generating system.

In one particular embodiment of the invention, the high voltage applied to the points or the wire electrode is designed to be of very low power and high ionization efficiency. This is accomplished by using very strong, micro-second wide pulses at a very low rate. A flyback type generator produces such waves naturally in a resonant circuit. Each wave includes at least three voltage peaks: a beginning low amplitude peak, a second high amplitude peak of opposite polarity, and a final low amplitude peak (wave). Typically, only the high level wave is used for ionization. The first wave and third wave can be reduced greatly in amplitude by a proper damping, as explained later. The use of such low power reduces ozone generation, corona byproduct production, collection and shedding of particles, and wear of the emitters.

In yet another particular embodiment of the invention, an ionization method includes providing a pulse duration that is relatively short such that an applied power is enough (or sufficient) for a corona discharge to generate positive and negative ions but not enough (not sufficient) to generate ozone and nitrogen oxides, erode emitter, and/or attract particles from ambient air In yet another particular embodiment of the invention, an ionization method may optionally include providing a simultaneous application of voltage to a linear wire or group of linear emitters in order to reduce the usual ion density variation effect between points, and allow an even ion balance distribution along the length of the ion emitter structure. In another embodiment of the invention, this optional method may be omitted.

In another embodiment, a method for generating ions within a space separating an emitter and a reference electrode, the method comprising: generating a variable number of small sharp pulses and rate of the pulses depending on the distance of the target from the emitter.

In yet another embodiment of the invention, an apparatus and a method for generating ions within a space separating an emitter and a reference electrode, includes: providing at least one pulse train to the emitter, the pulse train pair including a positive pulse train and a negative pulse train the alternate in sequence, the positive pulse train including a first plurality of ionizing positive voltage pulses during a positive phase and a second plurality of ionizing positive voltage pulses during an ionization frequency phase which occur after the positive phase, and the negative pulse train including a first plurality of ionizing negative voltage pulses during the ionization frequency phases a second plurality of ionizing negative voltage pulses during a negative phase which occur after the ionization frequency phase; wherein each of the first plurality of ionizing positive voltage pulses has a greater magnitude than a magnitude of each of the second plurality of ionizing positive voltage pulses; and wherein each of the first plurality of ionizing negative voltage waveform has a greater magnitude than a magnitude of each of the second plurality of ionizing negative voltage pulses.

BRIEF DESCRIPTION OF THE DRAWINGS

FIG. 5*e* is a table that shows multi-pulse settable parameters and corresponding definitions and exemplary parameter range values, in accordance with an embodiment of the present invention.

DETAILED DESCRIPTION OF THE INVENTION

In the following detailed description, for purposes of explanation, numerous specific details are set forth to provide a thorough understanding of the various embodiments of the present invention. Those of ordinary skill in the art will realize that these various embodiments of the present invention are illustrative only and are not intended to be limiting in any way. Other embodiments of the present invention will readily suggest themselves to such skilled persons having benefit of the herein disclosure.

An embodiment of the present invention can apply to many types of air-gas ionizers configured as ionizing bars, blowers, or in-line ionization devices.

Pulse mode ionizers are known in the art. For example, patent application publications JP2008124035, US 20060151465, and US 20090116828 describe AC ionizing bars. U.S. Pat. No. 8,009,405 discloses a design of ionizing blowers with high voltage power supplies generating periodically burst of positive and negative pulses.

These power supplies include plus and minus DC high voltage sources and a summing block connected to an ion emitting structure. Low frequency pulses (in the range of approximately 0.1 Hz to 100 Hz) are generated by independently switching on and off each of high voltage source. However, these AC pulse ionization systems are complicated, have low efficiency, and are prone to accumulate particles on the ion emitting structures.

One of the main features of an embodiment of the present invention is the use of groups of predominately asymmetric (in magnitude of positive or negative voltages) short duration bipolar ionizing pulses. A train (i.e., pulse group) of positive and negative pulses is applied to a linear emitter or group of emitters.

The short duration pulses (in the asymmetric waveform) create a high voltage gradient, which reduces ion recombination at the emitter, which in turn increases the emitter ionization efficiency, thus allowing the use of a relatively or extremely low power consumption method to generate high concentration plus and minus ions.

In an embodiment of the invention, positive and negative ion clouds are periodically generated by trains of pulses having variable pulse number, for each pulse duration, train pulse duration and voltage amplitude. The number of voltage waveforms can be generated by a small high voltage transformer with primary winding controlled by low voltage pulse generator and secondary winding forming a resonance circuit including an ion emitter and reference electrode of the bar.

Figure 1:
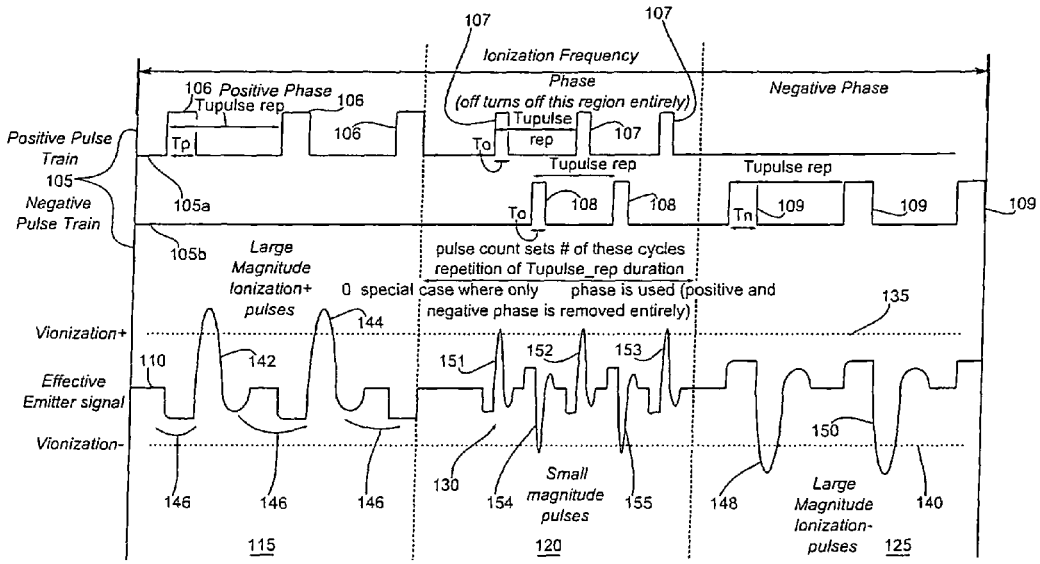
FIG. 1 illustrates voltage waveforms of positive and negative ionizing pulses and pulse trains, in accordance with an embodiment of the present invention.

FIG. 1 illustrates voltage waveforms of positive and negative ionizing pulses and pulse trains, in accordance with an embodiment of the present invention. Low voltage pulses 105*a* and 105*b* (for controlling an input of a high voltage transformer) are shown in top part of FIG. 1. Each ionizing pulse, for example, a positive pulse, may include a sequence of three different voltage wave components. The output pulse starts with negative voltage wave having amplitude lower than corona discharge threshold (see waveform 110 in the bottom part of FIG. 1). The duration of this period is in the range of few micro-seconds or nano-seconds.

As shown in FIG. 1, the pulse train 105 is disposed to include the positive pulse train 105*a* and the negative pulse train 105*b*, with pulse trains 105*a* and 105*b* alternating in sequence. The pulse train 105 is provided to an emitter. FIG. 1 also illustrates the effective emitter signal 110 that results from the pulse train 105.

The positive pulse train 105*a* includes the following: a plurality of ionizing positive voltage pulses 106 having a period of Tupulse_rep and a pulse width of Tp during a time period 115 (positive phase 115), a plurality of ionizing positive voltage pulses 107 having a period of Tupulse_rep and a pulse width of To (where To<Tp) during a time period 120 (ionization frequency phase 120) which occurs after the positive phase 115, and a zero value during a time period 125 (negative phase 125) which occurs after the ionization frequency phase 120.

The negative pulse train 105*b* includes the following: a zero value during a time period 115 (positive phase 115), a plurality of ionizing negative voltage pulses 108 having a period of Tupulse_rep and a pulse width of To (where To Tp) during the ionization frequency phase 120 and were the pulses 107 and 108 are offset from each other and are not generated concurrently, a plurality of ionizing negative voltage pulses 109 having a period of Tupulse_rep and a pulse width of Tn during the time period 125 (negative phase 125), where Tp and Tn may or may not be equal in time magnitude.

These ionizing positive and negative voltage pulses alternately create voltage gradients across the emitter and a reference electrode of the ionizer and generate by corona discharge an ion cloud that include positive and negative ions. As discussed further below, the positive and negative ionizing voltage pulses 107 and 108 during the ionization frequency phase 120 results in an effective emitter signal 110 having small magnitude alternating pulses 130.

As shown for time period 115, waveform 110 includes a high positive voltage wave with amplitude higher than positive corona threshold for a given ion emitting structure. At that period of time, the ion emitter generates positive ions in a gap between the ion emitter and non-ionizing (or reference) electrode. This gap between the ion emitter and non-ionizing electrode is shown, for example, in FIG. 6 of the above-referenced parent application U.S. Ser. No. 13/210,267. The positive ion cloud is electro-statically repelled from the ion emitter and moves (or is most likely blown) to the reference electrode.

During the time period 125 is a negative voltage with amplitude significantly lower than that required for a corona discharge. This voltage creates electrostatic field which slows down movement of positive ions and decreases ion losses to the reference electrode. The amplitude of the negative voltages may be adjusted by damping feature in the HVPS (High Voltage Power Supply) circuitry.

A positive ionizing pulse is followed by a high amplitude negative pulse (also shown in FIG. 1) which produces negative ion cloud during short period of time in the same manner as previously discussed. A repetition rate of ionizing pulses may be in the range of one to several thousand pulses per second.

The effective emitter signal 110 includes the ionization pulses 142 and 144, where the pulses 142 and 144 may be followed by smaller negative and positive oscillations 146. The negative and positive oscillations 146 are due to circuit resonance of a power supply used to generate the signal 110 and are not intended to limit the present invention in any way. The oscillations 146 may be substantially reduced or completely eliminated by, for example, used of a damping circuit as disclosed in, for example, to U.S. application Ser. No. 13/023,387.

The non-ionizing pulses 148 and 150 has a polarity (negative) that is opposite of the polarity (positive) of the ionizing pulses 142 and 144.

FIG. 1 also shows simultaneously (in the middle time period 120 between time periods 115 and 125) a group of positive and negative ionizing pulses 130. The upper dashed line 135 shows positive corona threshold voltage, for example, usually approximately in the 4.0 kV to 5.0 kV range, and the lower dashed line 140 shows negative corona threshold voltage, for example, approximately in the 3.75 kV 4.50 kV range. Pulses exceeding negative corona threshold voltage generate negative ions and pulses exceeding positive corona threshold voltage generate positive ions.

A solution for static charge neutralization that uses few, short, higher voltage pulses 151, 152, 153, 154, and 155 in the microsecond range has been discovered to provide sufficient ionization with a low generation of ozone and reduced collection of contaminates on the emitter surfaces.

A pulse train is disposed to provide alternating positive and negative voltage waveforms with each pulse including a first non-ionizing voltage level, a second ionizing voltage level, a third non-ionizing voltage level and insignificant further oscillations due to circuit resonance. An analog or logic type switching circuit (see FIG. 3) provides for a series of alternating positive and negative ionization pulses.

The use of flyback generation of high voltage (generated by a flyback-type generator) in a Ferrite core transformer provides a simple, efficient and inexpensive ionizer high voltage power supply which can use a very small transformer (e.g., about 1"×1"×1") with moderate turn ratio and without the need for a voltage multiplier circuit for the positive and negative ionizing pulses. The use of a Ferrite core with small gap between core halves and proper voltage oscillation damping reduces core magnetic memory effect, allowing the use of multiple series of ionization pulses of one or the other polarity pulses.

As a result, trains (series or group) of ionizing positive and negative pulses provide efficient bipolar ionization for at least one emitter electrode having length in the range approximately 100 mm-2000 mm or more.

The number of pulses of one polarity can be adjusted for the best object neutralization discharge time depending on air flow and distance to a charged target. The concentration of alternating polarities ions is sufficient for ionizing bars for neutralizing moving targets at distances up to approximate 1000 mm or more.

Figure 2:
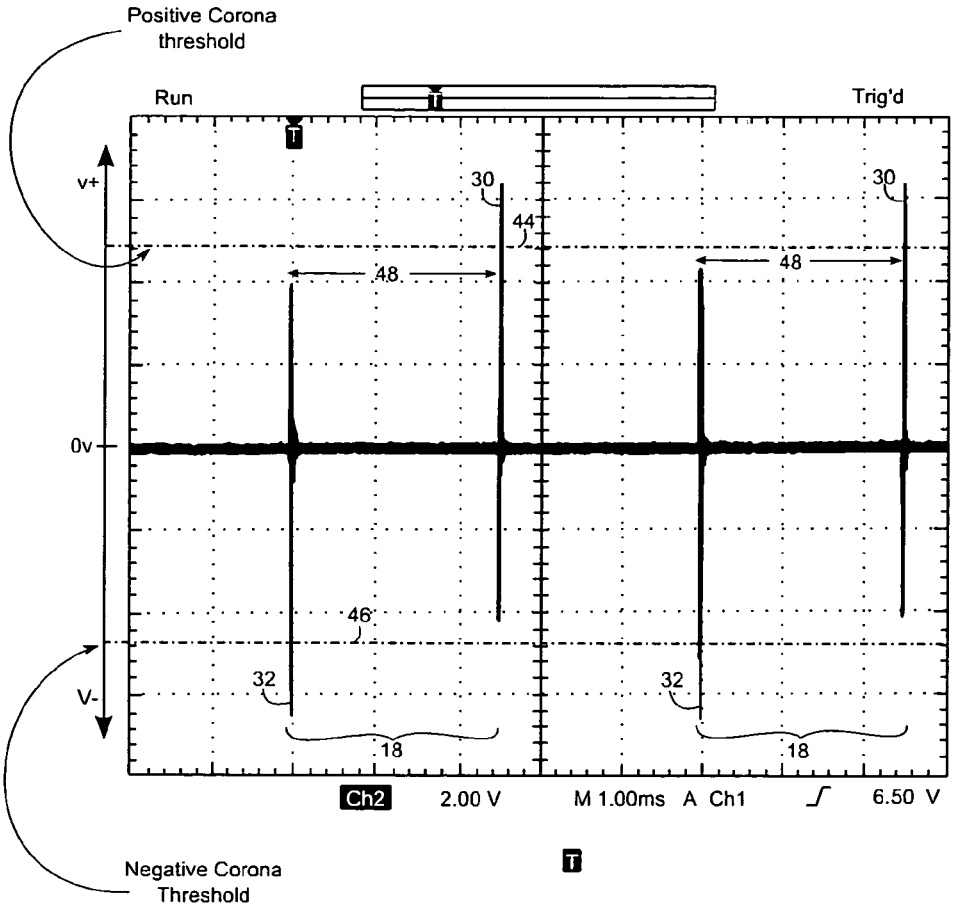
FIG. 2 illustrates a scope screen shot with a voltage waveform of exemplary train positive and negative ionizing pulses in the real time domain, in accordance with an embodiment of the present invention.

FIG. 2 illustrates a scope screen shot with a voltage waveform of exemplary train positive and negative ionizing pulses in the real time domain, in accordance with an embodiment of the present invention. As seen in FIG. 2, pulse train pair 18 includes positive and negative pulse trains 30 and 32 that alternate in serial sequence. The upper dashed line 44 represents a positive corona threshold voltage (e.g., 4.5 kV), and the lower dashed line 46 represents a negative corona threshold voltage (e.g., −4.25 kV). The positive corona threshold voltage level 44 and negative corona threshold voltage level 46 are shown in the real time domain. Each positive pulse train 30 is disposed to include an ionizing positive voltage waveform that has a maximum positive voltage amplitude that exceeds the voltage threshold for creating positive ions by corona discharge. Similarly, the negative pulse train 32 is disposed to include an ionizing negative voltage waveform that has a maximum negative voltage amplitude that exceeds the voltage threshold for creating negative ions by corona discharge. Thus, these respective positive and ionizing negative voltage waveforms alternatively create voltage gradients across a space between the emitter and reference electrode, generating by corona discharge an ion cloud that includes positive and negative ions.

Pulses repetition rate can be adjusted depending upon required ionization power level and velocity of the moving target. This screen shot demonstrates that an effective ratio of high voltage power "On" vs. power "Off" can be about 0.0015 or smaller. That is why according an ionization method disclosed in an embodiment of this invention, the corona discharge typically exists for only a tiny portion of time (less than about 0.1%) necessary for ion generation but less than required for ozone emissions as well as particles attraction to the ion emitters.

Experiments with one wire type ionization system (or ionization cell) showed that the voltage wave form with micro ionizing pulses provides approximately 3 to 5 times reduction of ozone emission at approximately the equal charge neutralization efficiency. For example, an ionizer similar to described in US application publication 2008/0232021, powered by AC high frequency supply generates ozone concentration of approximately 50 parts-per-billion (ppb) or higher, compared with approximately 10 ppb to 15 ppb for same ionizer in accordance with an embodiment of the present invention.

Figure 3A:
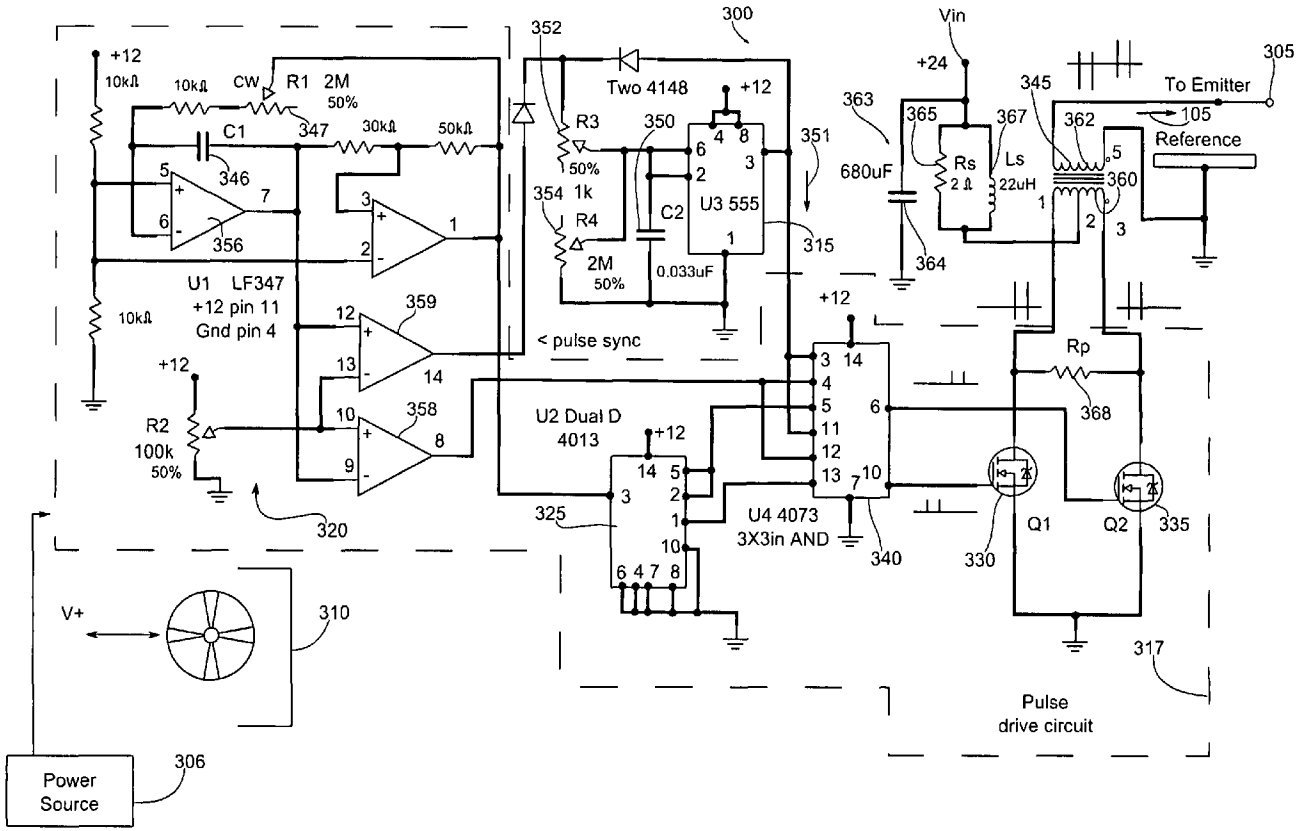
FIG. 3*a* shows schematic diagram of one analog/logic base embodiment of present invention for an ionizing bar with one wire type emitter electrode.
Figure 3B:
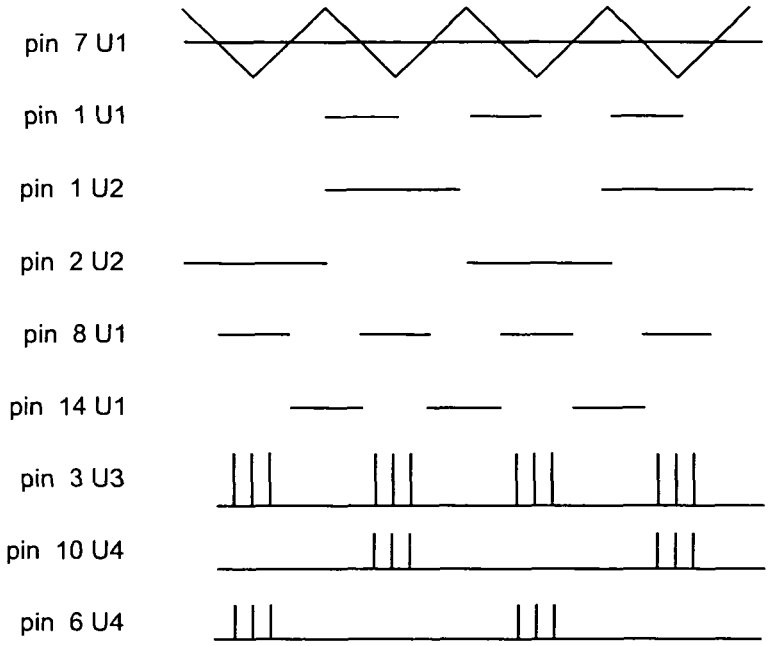
FIG. 3*b* shows waveform diagrams into various inputs of various components in FIG. 3*a*.

FIG. 3*a* shows schematic diagram of one embodiment of an analog/logic base 300 of present invention for an ionizing bar with one wire type emitter electrode 305. Additionally, FIG. 3*b* shows waveform diagrams into various inputs of various components in FIG. 3*a*. A gas source 310 is disposed to provide a flow of gas and is electrically coupled to a voltage source V+. The pulse train 105 (formed by positive pulse train 105*a* and negative pulse train 105*b* as shown in FIG. 1) is received by the emitter 305.

The power source 306 may be part of the analog/logic base 300 or may be a separate component that provides power to the components in the base 300. For purposes of clarity in the drawings, the reference node (such as ground) is omitted in FIG. 3*a*. The values of the components (e.g., passive elements such as resistors, inductors, and capacitors) in FIG. 3*a* are not intended to limit embodiments of the invention in any way.

In circuit operation of the analog/logic base 300, a timer chip (U3) 315 provides short pulses for a pulse drive circuit 317 (or power supply 317) formed by a Dual Delay logic chip (U1) 320, Adder logic chip (U2) 325, transistors (Q1) 330 and (Q2) 335, and switching circuit 340. The transistors 330 and 335 may be, for example, MOSFETs. However, the use of MOSFETs (e.g., n-channel MOSFETs or other MOSFET-type transistors) is not intended to limit embodiments of the invention in any way.

The timing of high voltage pulses from the high voltage output transformer 345 depends first upon the clock signal generated by the trapezoid oscillator (U1) 320. Its oscillating frequency determines the alternating switch from positive pulse generation to negative pulse generation, called Frequency of operation. The frequency is determined by the fixed capacitor (C1) 346 and adjustable resistor (R1) 347. A frequency range of approximately 0.2 to 60 Hertz is commonly used, with a low frequency used for targets at a distance and a higher frequency used for targets at close distance.

The output signal from oscillator (U1) 320 is fed to Delay device (U2) 325, which generates opposite phase signals at half the frequency. The output from device (U2) 325 is then fed to AND gate (U4) 340, which is used to flip the possible activation of transistors 330 and 335 (e.g., MOSFET drive transistors (Q1) 330 and (Q2) 335).

The main activating pulse is generated by timer device (U3) 315. Feedback (signal 351) from the output pin 3 (of timer device 315) is fed back to its trigger pin 2 and threshold pin 6. This allows a very short positive pulse to be generated at output pin 3. The pulse width is controlled by the fixed capacitor (C2) 350 and adjustable resistor (R3) 352. The pulse width is generally adjusted to approximately 2 microseconds to 24 microseconds, depending on the design of the flyback output driver 317. The repetition rate of the pulses is determined by the fixed capacitor (C2) 350 and variable resistor (R4) 354. The repetition rate is equal to the inverse of the pulse period. This pulse repetition rate can range from approximately 20 Hertz to 1000 Hertz and thus determines the power output of the high voltage generator and is typically approximately 250 Hertz.

The AND gate (U4) 340 mixes the flip flop signal and the microsecond wide pulses from the chip (U3) 315 and thereby applies activation pulses to the gates of driver transistors (Q1) 330 and (Q2) 335, alternately.

One output phase from the pin 7 (of comparator 356 of the chip (U1) 320) is used to stop the oscillation in chip (U3) 315, thus interrupting the output pulses from Pin 3 of chip (U3) 315. This interruption can be used to provide an Off-time between the positive and negative ionizations. This interruption is sometimes used to decrease ion cloud recombination at large target distance, or simply to reduce the power output. The Off-time or Dead-time is adjusted by the bias applied to pins 10 and 13 (of comparators 358 and 359, respectively, in chip (U1) 320).

A formation of a micro pulse is achieved by the following operation. As an example, a short positive pulse (in the micro second range) to the gate of MOSFET (Q2) 335 causes current to flow in high voltage transformer 345 primary winding coil (2,3) 360, producing first a small negative voltage pulse across the primary winding coil 360. At the end of the negative voltage pulse, a large positive flyback pulse of voltage is produced, along with small negative and positive oscillations due to circuit resonance.

Alternatively, a short pulse to the gate of MOSFET (41) 330 produces a large negative pulse. These pulse voltages are magnified and phase reversed by transformer 345 secondary winding 362 by use of a large turns ratio which can be in the order of about 50 to 500 to one. Thus MOSFET (Q2) 335 initiates a negative high voltage pulse and MOSFET (Q1) 330 initiates a positive high voltage pulse. These pulses generate positive and negative ions by the same wire or a pointed emitter.

The pulse voltage amplitude for both positive and negative polarities is determined by the following parameters:

1. the transformer (T1) 345 winding turns ratio;
2. the transformer primary coil 360 inductance;
3. the duration of the MOSFETs gate pulse driven into the gates of transistors 330 and 335;
4. the input DC voltage as seen at capacitor 364 which is an electrolytic filter;
5. the primary damping circuit 363 which is formed by the damping circuit resistor 365 (e.g., 2 Ohms in resistance), inductor 367 (e.g., 22 uH in inductance), and shunt resistor (Rp) 368 across the primary coil 360;
6. the resistance of series connected transistors 330 and 335 (e.g., MOSFETs (Q1) 330 and (Q2) 335); and
7. the capacitive load of the ionizing assembly (as measured at the output of the transformer secondary winding 362).

The high voltage output pulses from the transformer (T1) 345 have a wave shape set by the inductance of the primary winding 360, and the capacitive load on the secondary and primary damping components of damping circuit 363. The shunt resistor (Rs) 365 and inductor (Ls) 367 placed between the transformer center tap 2 and power input (Vin) prevents a rapid rise-time of current in the transformer 345, thus decreasing the peak value of the first part (part 115 in FIG. 1) of the wave-form 110 (FIG. 1). The third part 125 (FIG. 1) of the wave-form 110 is reduced by shunt resistor (Rs) 365. Selected or careful adjustment of these components will result in maximum ionization efficiency beyond the requirement of a high peak level of the second part 120 (FIG. 1) of the wave-form 110.

Referring again to FIG. 2, there is seen a high slew rate of the generated pulses. For the primary coil 360, the voltage rise the rate is about 270 V/μs and the fall rate is about 1800 V/μs. For the secondary coil 362, the slew rate may go up to about 35 (+/−8) kV/μs. Asymmetric positive and negative pulses may be continuously produced by driving circuit 317 with use of only one small power high voltage transformer 345 without any multipliers, rectifiers and summing blocks.

It is also noted that the pulse repetition rate may be adjusted depending upon the charge density and speed of the neutralization target. Other details regarding signal transmissions (e.g., current signals or voltage signals) that are known to those skilled in the relevant art(s) is not discussed further for purposes of focusing on embodiments of the present invention. Various standard signal transmissions occurring AC corona ionizers are discussed in additional details in the above-cited references. The wave shapes are fixed by the resistance, capacitance, and inductance (R, C, L, respectively) values of all the components. The pulse heights can be adjusted by changing the pulse duration which is set in FIG. 3 by the resistor (R3) 352 and capacitor (C2) 350 associated with the device (U3) 315.

Figure 4A:
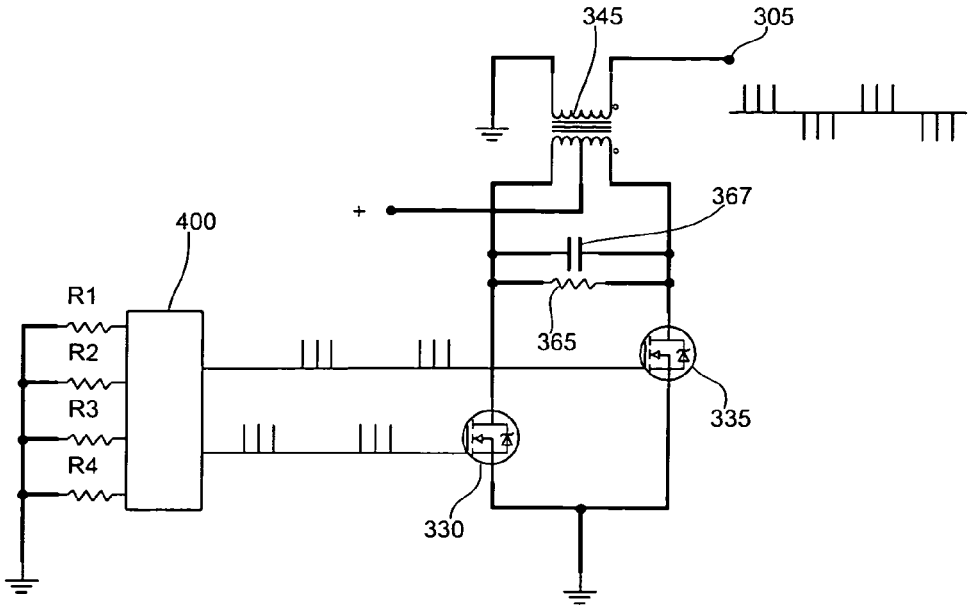
FIGS. 4*a* and 4*b* are block diagram of a microprocessor based embodiment of present invention.
Figure 4B:
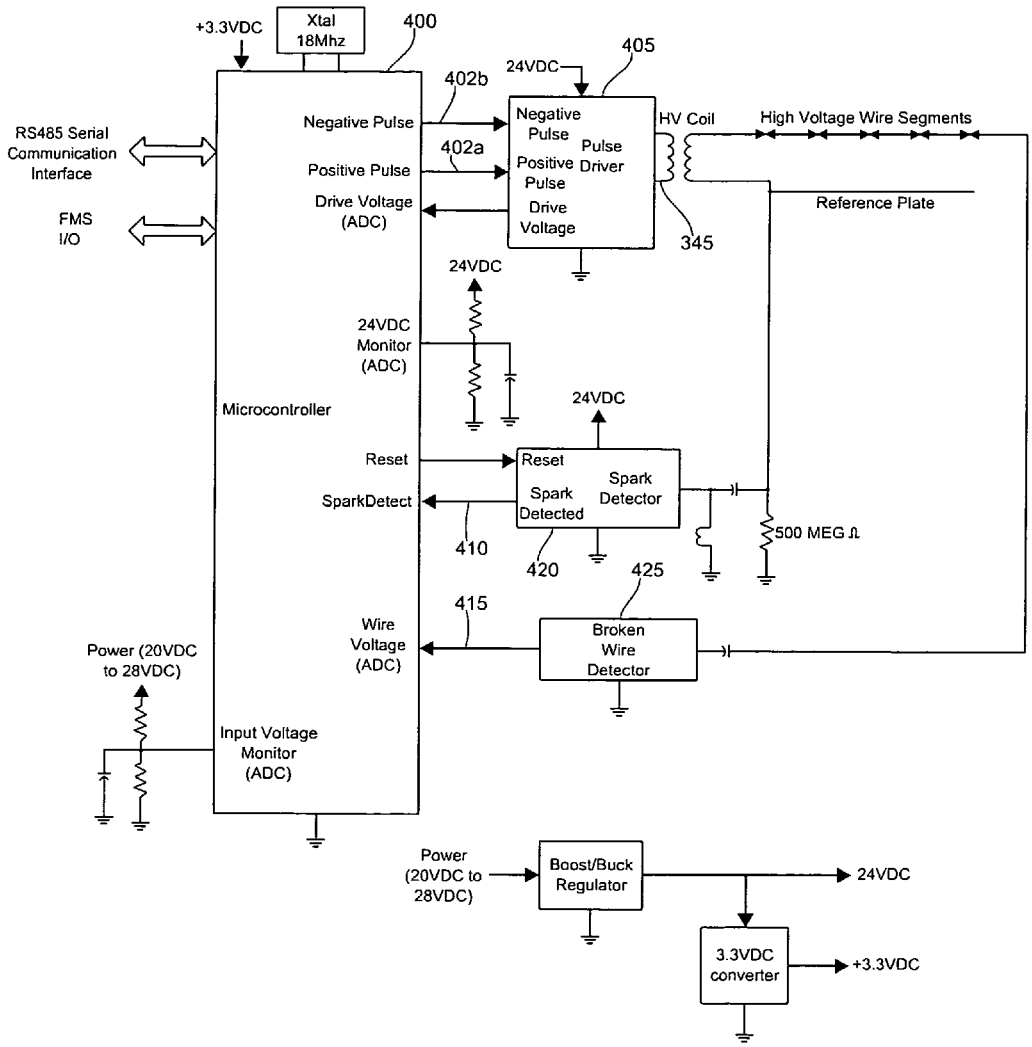

FIGS. 4*a* and 4*b* are block diagram of a microprocessor based embodiment of present invention. As shown in FIG. 4*a*, the pulse drive circuit includes a microcontroller 400 (or other processor or controller 400) for controlling the switching of the transistors 330. The microcontroller 400, under software control, generates narrow software adjusted pulses, typically approximately 19 microseconds wide, with one pulse train 402*a* for positive ionization pulses and one pulse train 402*b* for negative ionization pulses. From the microcontroller 400, the pulses are applied to a set of pulse drivers 405 (FIG. 4*b*) which amplify the pulses in a suitable magnitude to drive the switching transistors 330 and 335 (FIG. 3*a*) which can be, for example, high power MOSFETS. As discussed above, these MOSFETS then drive the high voltage pulse transformer 345.

As an option that can be omitted in other embodiments of the invention, the microcontroller 400 can also receive signals 410 and 415 from a spark detector 420 and a broken wire detector 425, respectively. In either of the embodiments shown in FIGS. 3*a* and 4*a* and/or other figures/drawings herein, the pulse duration may be short such that applied power is enough for corona discharge to generate positive and negative ions but not enough to generate ozone and nitrogen oxides, erode an emitter and attract particles from ambient air. In either of the embodiments shown in FIGS. 3*a* and 4*a* and/or other figures/drawings herein, the ionizer provides strong (or relatively strong) ionizing pulses of at least about 1000 Volts above an ionizing threshold at a very slow rate, such as, for example, about 250 Hertz (or less) instead of the usual approximately 50,000 to 70,000 Hertz, thus producing ions with low ozone.

Figure 5A:
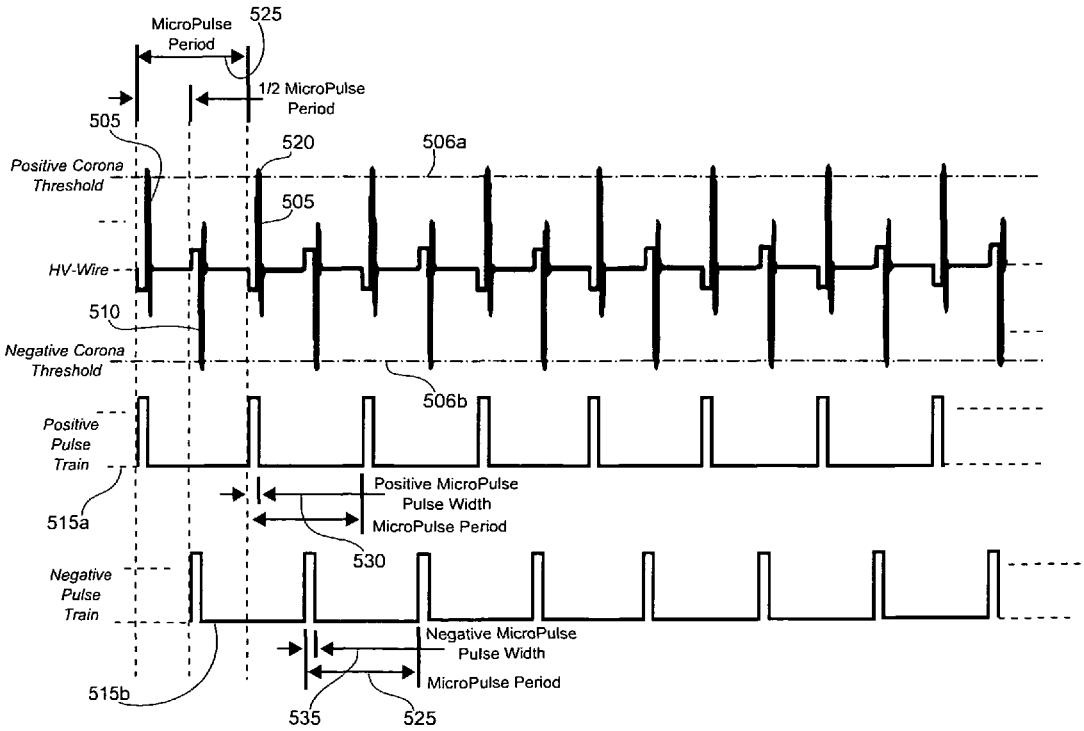
FIGS. 5*a*, 5*b* and 5*c* shows multi-Pulses in three differed modes to optimize high voltage waveform (pulse trains) for different charge neutralization conditions, in accordance with an embodiment of the present invention.
Figure 5B:
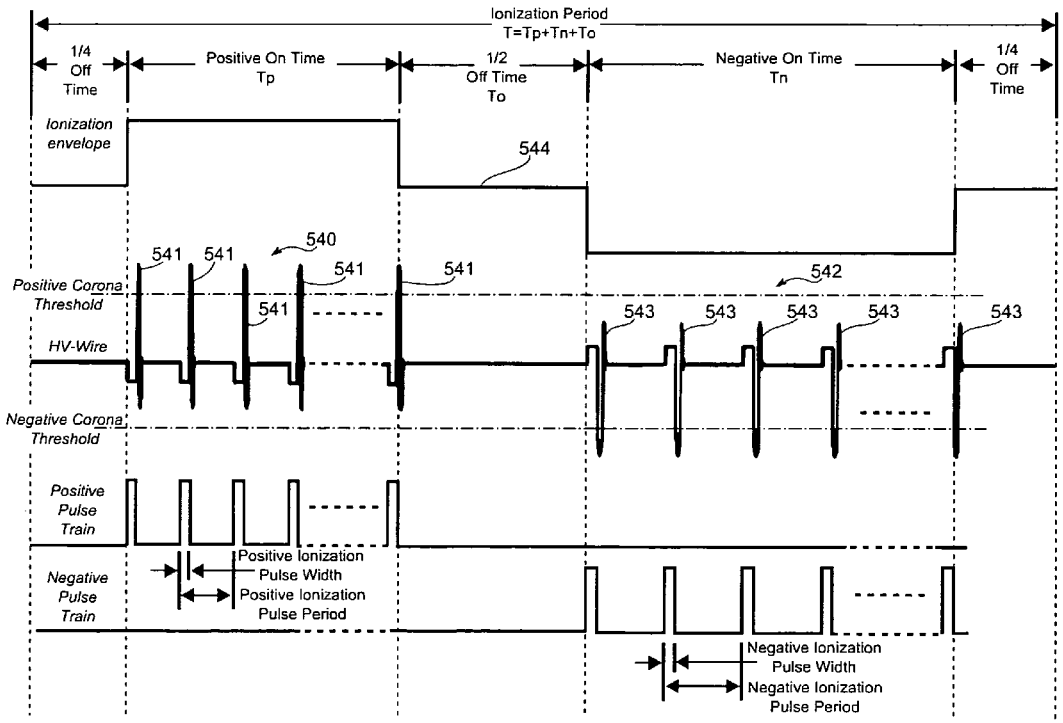
Figure 5C:
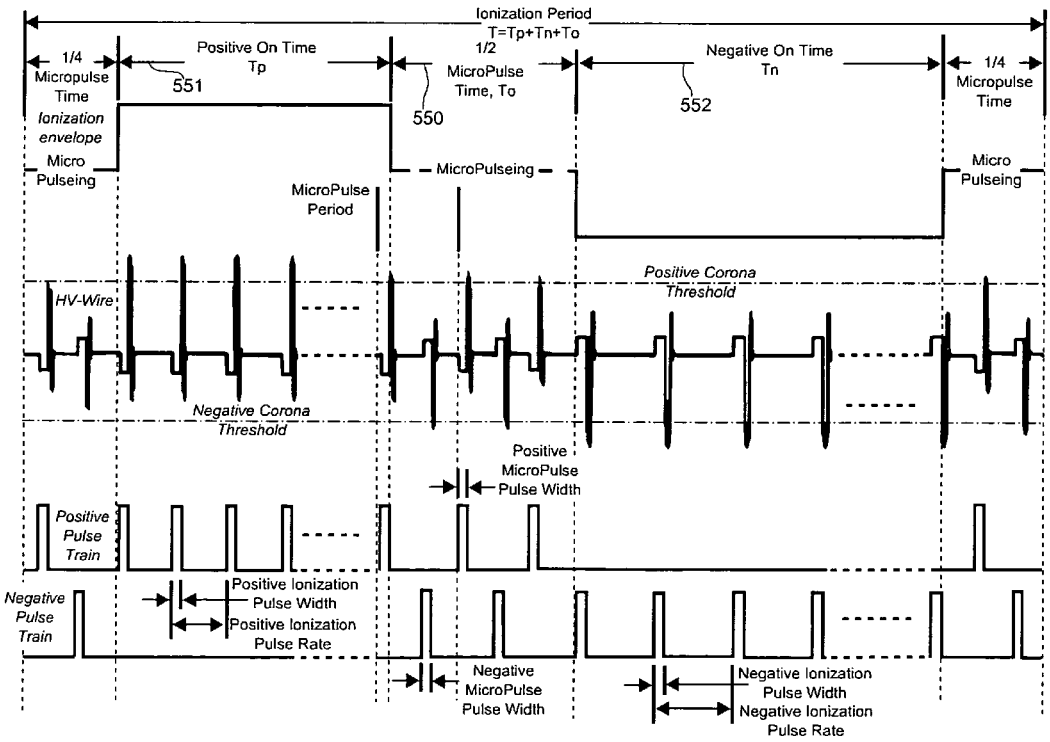
Figure 5D:
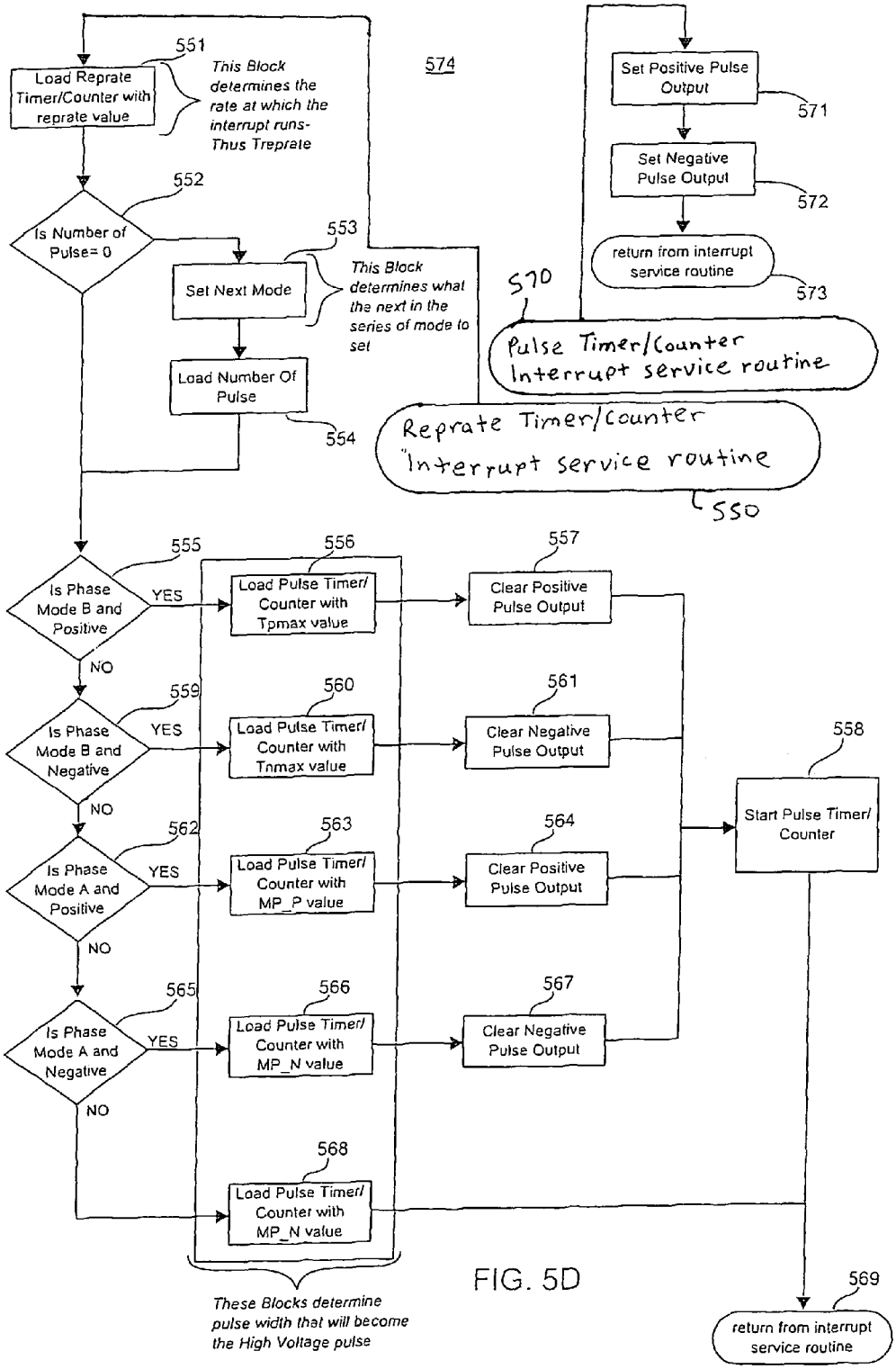
FIG. 5*d* is a flow diagram of a method performed by a software executed by the controller of FIGS. 4*a* and 4*b*, in accordance with an embodiment of the present invention.

FIGS. 5*a*, 5*b* and 5*c* shows multi-Pulses in three differed modes to optimize high voltage waveform (pulse trains) for different charge neutralization conditions and FIG. 5*d* shows a method performed by a software executed by the microcontroller 400, in accordance with an embodiment of the present invention. The modes A, B, and A+B depends on the charge neutralization requirements such as, for example, the discharge time for positive and negative charges, acceptable voltage swing (electrical field effect), and distance to the target. The microcontroller 400 executes software that can provide the three (3) modes of ionization pulse: Mode A, Mode B and Mode A+B as required by the application implementing an embodiment of the invention.

Mode A: As shown in FIG. 5*a*, Mode A is defined by a repeating series of interlacing positive and negative pulses. Each positive pulse 505 (exceeding the positive corona threshold 506*a*) is followed by a negative pulse 510 (exceeding in the negative corona threshold 506*b*), and each negative pulse 510 then followed by a positive pulse 505. The positive pulse train 515*a* and negative pulse train 515*b* are shown with the alternative positive and negative voltage pulses. This mode is typically used at very close target distance (e.g., about 200 mm or closer) where ionization fields voltage needs to be small.

In Mode A, the pulse amplitude 529, micropulse period 525, and pulse widths 530 and 535 of the positive micropulse 505 and negative micropulse 510, respectively, are adjustable, by the software executed by the microcontroller 400. The positive micropulse amplitude and positive micropulse duration is adjusted by the timer/counter with Load Pulse MP_P value in block 563 (FIG. 5*d*). The negative micropulse amplitude and negative micropulse duration is adjusted by the Load Pulse MP_N in block 566 (FIG. 5*d*). The period for the positive micropulse and negative micropulse is adjusted by the Load Reprate timer/counter with the reprate value in block 551 (FIG. 5*d*).

Mode B: As shown in FIG. 5*b*, Mode B is defined by a repeating series 540 of positive pulses 541 followed by a repeating series 542 of negative pulses 543 followed by a repeating series 540 of positive pulses 541, and so on as shown in the drawings. In between the positive series 540 and negative series 542 of pulses, a small delay 544, OffTime, can be added, to reduce ion recombination. The OffTime is a time where no ionization pulse is created. This mode is typically used at very far (500 mm and above) target distances. The number of MP_N values in block 568 (FIG. 5*d*) loaded into block 554 (FIG. 5*d*) is used to set the Off Time delay value 544 (FIG. 5*b*) where no pulse is generated. The positive ionization pulse width is adjusted by the load pulse timer/counter with Tpmax value in block 556 (FIG. 5*d*). The positive ionization pulse period is adjusted by the load reprate timer/counter with reprate value in block 551 (FIG. 5*d*). The negative ionization pulse width is adjusted by the load pulse timer/counter with Tnmax value in block 560 (FIG. 5*d*). The negative ionization pulse period is adjusted by the load reprate timer/counter with reprate value in block 551 (FIG. 5*d*).

Mode A+B: As shown in FIG. 5*c*, Mode A+B is a combination of Mode A and Mode B where Mode A occurs in the OffTime region (time) 550 and Mode B occurs in the OnTime regions (time) 551 and 552. This mode is typically used at a mid-distance (200 mm to 500 mm) target where ionization fields voltage need to be kept low but the target distance changes depending on the process. The OnTime regions 551 and 552 are adjusted in block 554. The OffTime region 550 is adjusted by the number of pulses MP P and MP N determining this region width (i.e. set in block 554).

Figure 5F:
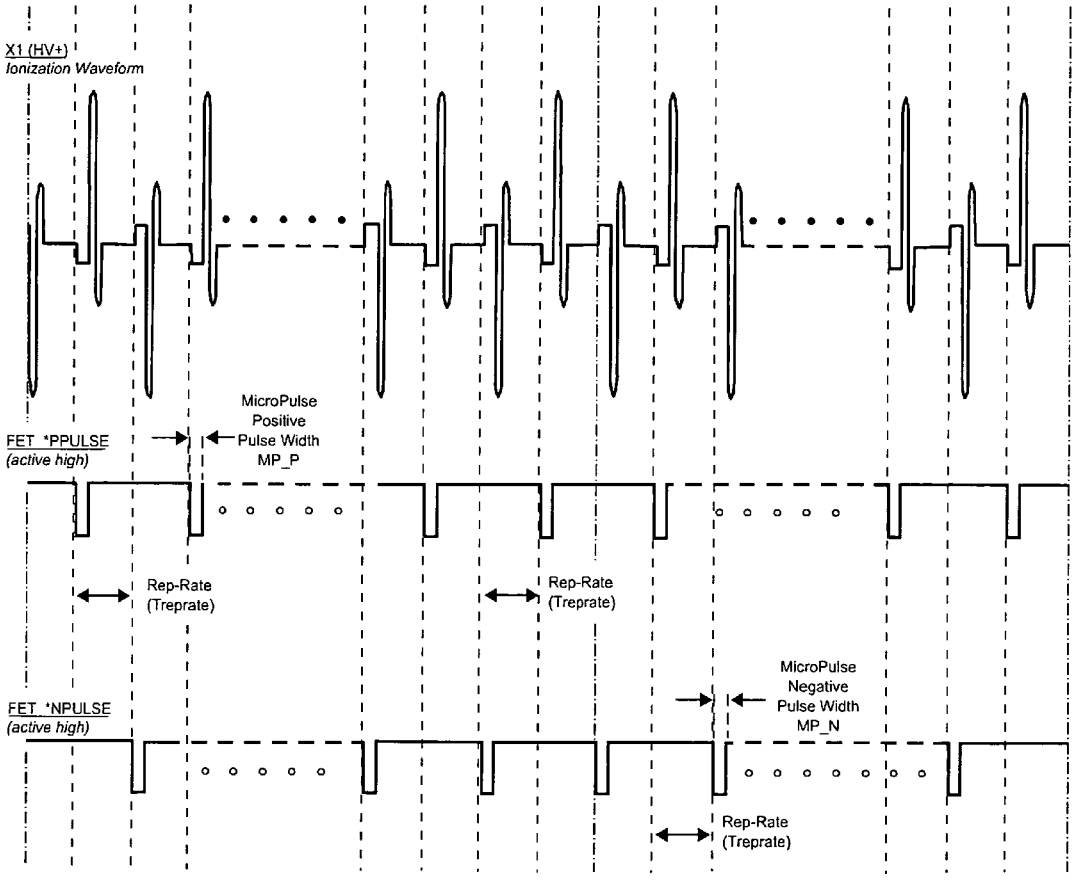
FIGS. 5*f*, 5*g*, and 5*h* shows multi-pulses in three differed modes based on settings different from FIGS. 5*a*, 5*b*, and 5*c*, in accordance with an embodiment of the present invention.
Figure 5G:
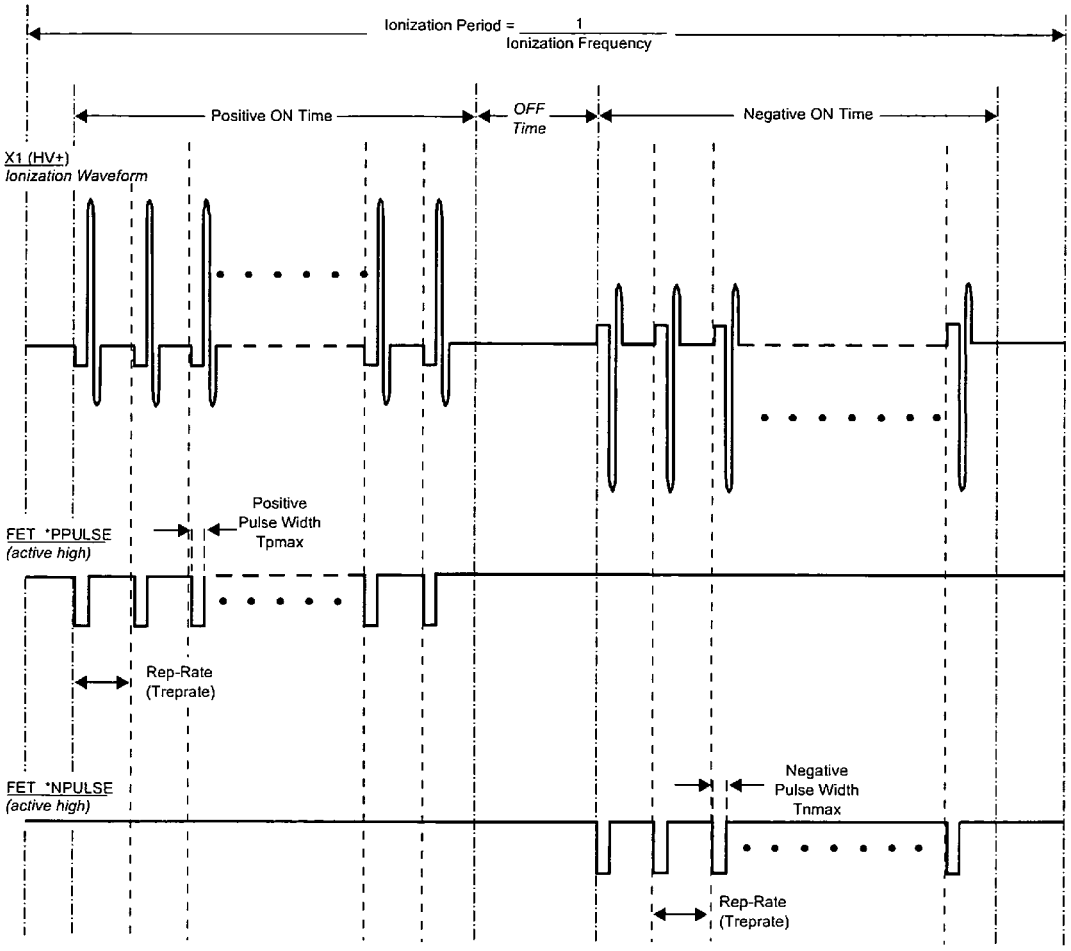
Figure 5H:
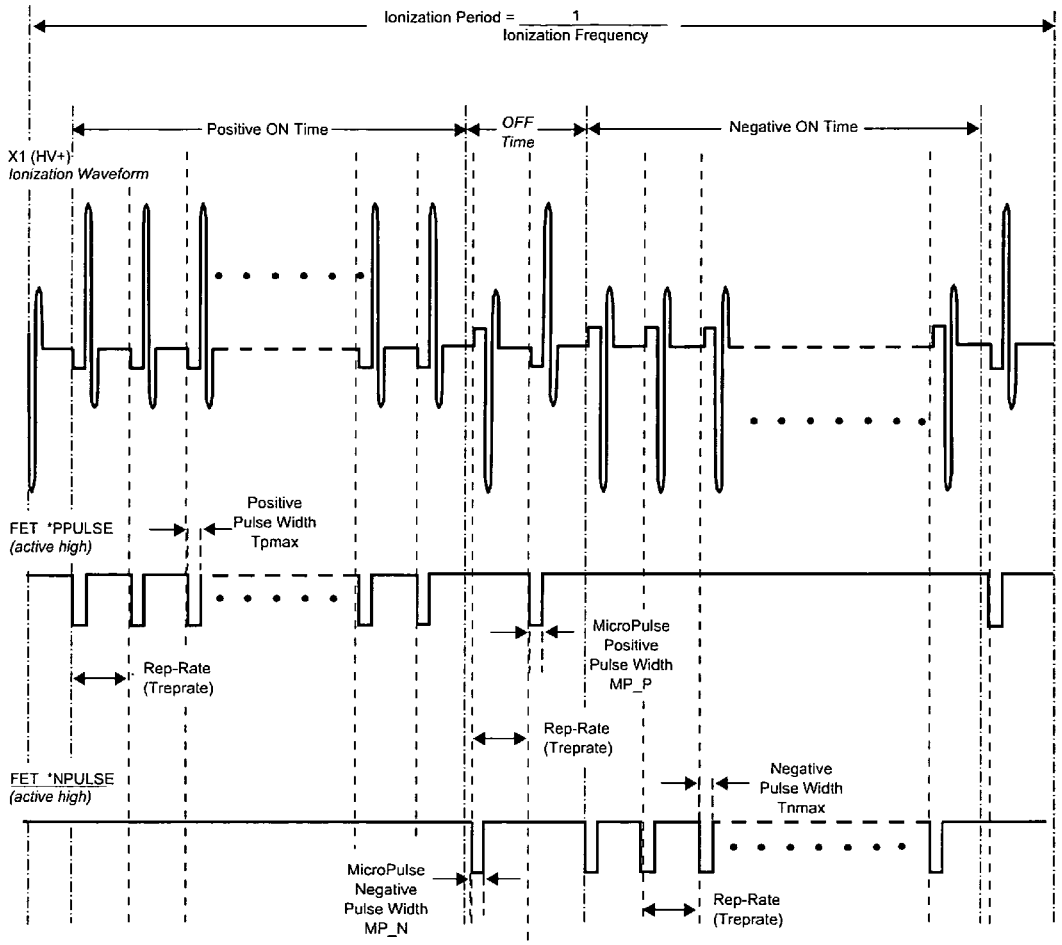

The positive micropulse width is adjusted by block 563. The negative micropulse width is adjusted by block 566. The negative ionization pulse width is determined by block 560. The negative pulse repetition rate is determined by block 551. FIG. 5*d* shows various blocks 550-573 describing other functions of a method 574 performed by a software executed by the microcontroller 400. FIG. 5*e* is a table 575 that shows multi-pulse settable parameters and corresponding definitions and exemplary parameter range values, in accordance with an embodiment of the present invention. FIGS. 5*f*, 5*g*, and 5*h* also shows multi-pulses in three differed modes based on settings different from FIGS. 5*a*, 5*b*, and 5*c*, in accordance with an embodiment of the present invention.

In all three (3) modes, the user can change the ion balance by: (1) changing the pulse width of the positive or negative or both, and control the amount of ionization in OnTime region (Tpmax and Tnmax) independently of the OffTime region (MP_P, MP__N); *and* (2) changing the ratio of time between the Positive OnTime region versus the Negative OnTime region. The time between pulses (Treprate) is the same in all regions and is adjustable to control the amount of ionization power. A high power is where Treprate is small, and creates more often ionization pulses, resulting in more ionization. On the other hand, a larger Treprate creates less often ionization pulses, resulting in less ionization.

Therefore, an embodiment of the present invention provides a method of ionization and associated schematic (apparatus). This embodiment generates very short bipolar micro pulses and creates efficient bipolar air (or other gases) ionization with regular emitters at normal atmospheric pressure.

Figure 8:
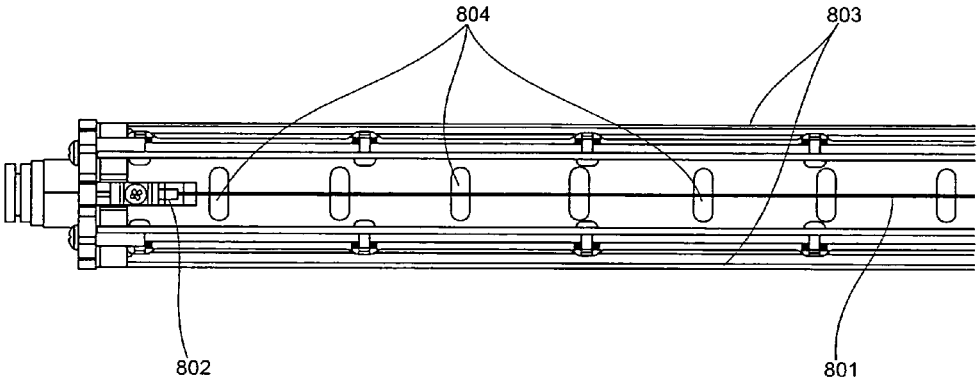
FIG. 8 shows general view of linear bar with wire emitter and air assist ion delivery system, in accordance with an embodiment of the present invention.

In an embodiment shown in FIG. 8, a high voltage pulse generator may power different ionizing cells (structures) with variety of ion emitters: single or group of wires, saw blade type emitter, and pointed electrode(s). Also, the ionizing bar may have internal source of air flow (air channel) connected to a nozzle, small diameter orifices or slots positioned in close proximity to the ion emitter. Therefore, FIG. 8 shows general view of linear bar with wire emitter and air assist ion delivery system, in accordance with an embodiment of the present invention.

Figure 6:
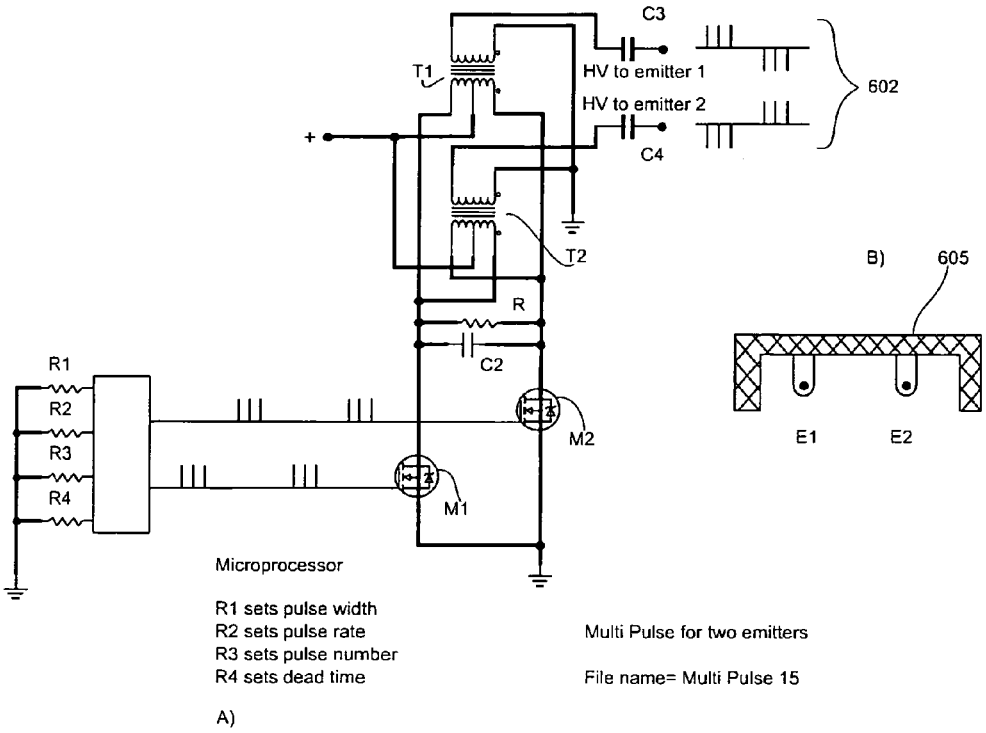
FIG. 6 shows schematic diagrams of another embodiment of present invention as a dual phase ionizing bar with two (wire or point type) emitter electrodes.

Another embodiment of the present invention related primarily to ionizing bars design. FIG. 6 shows schematic diagrams of another embodiment of present invention as a dual phase ionizing bar with two (wire or point type) emitter electrodes E1 and E2. In this dual phase ionizer with two emitters, the emitters both may be configured as a row of sharp pointed electrodes, wires or blades, or row of nozzles with pointed emitters. Additional details of elements in the linear bar are disclosed in the above-referenced U.S. Provisional Application No. 61/584,173.

The design of high a voltage section uses the same driver circuit for the MOSFETS (as previously discussed), but with the MOSFET transistor Drains (M1 and M2) connected to a pair of high voltage transformers T1 and T2 with opposing connections to the primaries.

Control Resistor R1 and damping capacitor C2 (in FIG. 6) are chosen to produce the same alternating polarity pulses as in the circuit design shown in FIG. 3. Each pulse will therefore have predominately positive or negative peak amplitude and will alternate in polarity.

Figure 7:
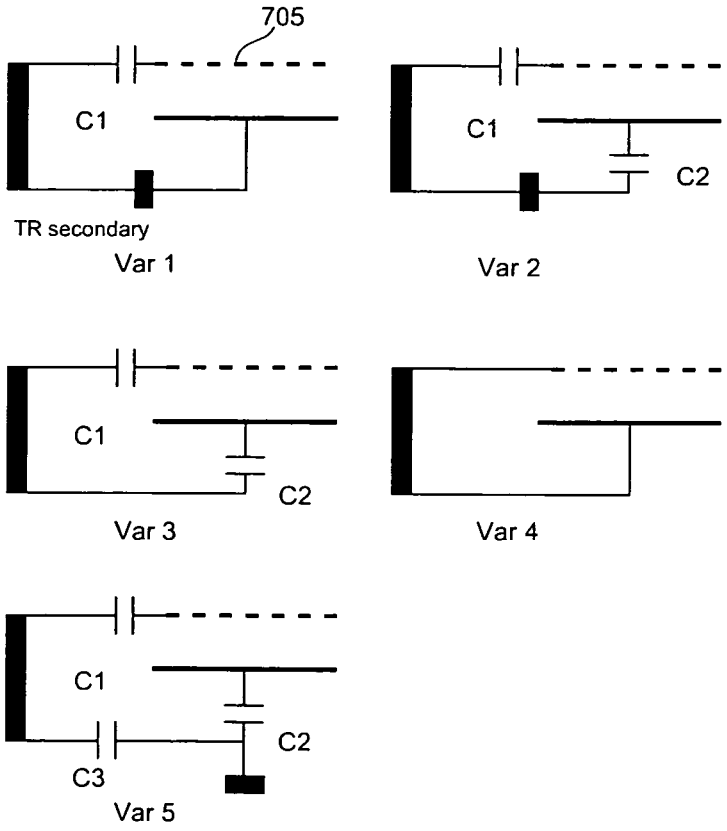
FIG. 7 shows variants of self balancing ionization structures for linear bar, in accordance with an embodiment of the present invention.

In FIG. 7, the capacitor C2 in series with the transformers T1 and T2 bottom legs allow the ionization system works in self balance mode. Both ion emitters are floating relatively to ground and according to the law of charge conservation output ion cloud should to be fairly well balanced. Otherwise, any normal unbalance produces an opposing DC voltage across capacitor C2. Additional details on methods for obtaining the above-mentioned balance is found in commonly-owned and commonly-assigned U.S. Pat. No. 5,055,963 by Leslie W. Partridge. U.S. Pat. No. 5,055,963 is hereby incorporated herein by reference.

The ion emitters connected to the transformers T1 and T2 have exactly opposite polarity voltage ionizing pulses. The voltage waveform 602 for this dual phase ionization system is shown in and simplified bar cross-section 605 with emitter (1) E1 and emitter (2) E2 is shown in FIG. 6.

This embodiment in FIG. 6 has at least a couple of advantages compare to single phase ionization system. Often objects of charge neutralization are sensitive to electrical field and require to have an ionizer with field canceling effect. Dual phase ionization system simultaneously generates opposite polarity voltages and thereby considerably reducing the radiated electrical field.

This feature is important also in cases when ionizing bar should be positioned in close proximity to the charged object. For a distance between ionizing bar and object duration of, for example, positive pulse train (pulse duration, amplitude or pulse frequency and so on), the distance may be longer than for negative pulse train in one cycle for one emitter; and to be opposite polarity situation in the next one cycle. That will crate ion cloud "pushing" effect and accelerate their movement to the target.

Dual phase ionization system has another advantage that it not has bulky reference electrode at all and avoids ion losses on these electrodes.

Moreover, the opposite phase voltage source significantly (almost twice) may decrease the required voltage amplitude at each emitter for producing corona discharge. Therefore, these transformers may be identical in design, or may have a lower primary to secondary turns ratio. A lower turns ratio may be used since the emitters, being close to each other, tend to increase the electric field between the emitter pair.

FIG. 6 shows also embodiment of a dual phase line ionizer where each emitter is capacitive connected (C3 and C4) to output of transformer T1 and T2. The secondary coils of both transformers T1 and T2 are grounded. This is another variant of capacitive coupled self balanced ionization system.

The difference between embodiments shown FIGS. 3 and 6 is mainly in time to react on ion balance offset. Capacitors (C3 and C4) may provide a shorter transition time for balancing. Also, small capacitors in series with each emitter may help to fine tune the phase shift between them and limit current in case of emitter touching.

Ion Balance Control:

In one embodiment, the ionizer may have self balance system in several different variants (shown in FIG. 7): a wire emitter (shown by dash line 705) may be capacitively coupled to HVPS output and grounded to a reference electrode, and the floated transformer secondary, both emitter and reference capacitively coupled to HVPS.

The linear ionizer also may have active ion balance system using external ion balance sensor(s) positioned in close proximity to the charged target. In this case microprocessor based control system and HVPS of the bar may generate primarily ionizing micro pulses and ions of one polarity opposite to the charge of the target.

A general view of linear ionizing bar with wire type emitter shown in FIG. 8. The wire electrode 801 is attached to the bar's chassis (or cartridge) by spring 802. The spring 802 provides wire tension and is connected to the output of one previously discussed high voltage power supplies (not shown in FIG. 8). The reference electrode 803 is configured as two stainless steel strips mounted on the sides of the chassis. A high intensity electrical field creates corona discharge in form of ion plasma sheath shrouding wire emitter.

The air orifices 804 supply air flow to help generated by emitter ions move to the target. Therefore, ions are moving to the charged target by combination of electrical field and aerodynamic forces. The result is short discharge time (in the range of seconds) to neutralize charge of the object.

While the present invention has been described in particular embodiments, it should be appreciated that the present invention should not be construed as limited by such embodiments. Rather, the present invention should be construed according to the claims below.

We claim:

1. A method of charge neutralization by generating bipolar ions in a corona discharge between an emitter and a reference electrode, the method comprising:

generating short duration and sharp micro pulses;

wherein each of the micro pulses comprises a positive voltage portion and a negative voltage portion;

wherein said micro pulses are predominantly asymmetric in magnitude and amplitude of positive and negative voltages; and wherein the magnitude of at least one polarity voltage exceeds the corona threshold.

2. The method of claim 1, wherein a pulse duration of the micro pulses is in nanosecond range such that an applied power is sufficient for corona discharge to generate positive and negative ions.

3. The method of claim 2, wherein the micro pulses are arranged in a pulse train with a duty factor as low as approximately 0.1% such that power applied to said emitter is sufficient for corona discharge to generate positive and negative ions while reducing a buildup of particles on emitter points or wire electrodes and minimizing a contamination associated with corona discharge particle emission from an ionizer and generating minimum ozone and nitrogen oxide.

4. The method of claim 1 wherein the pulses comprise strong ionizing wave or strong ionizing portion, said wave or portion having amplitudes higher than corona threshold voltages for both polarities for said emitter and non ionizing wave having opposite polarity voltage to the ionizing wave.

5. The method of claim 1, further comprising:

maintaining a reasonably close to zero ions stream balance by varying said number of pulses in at least one polarity pulse train.

6. The method of claim 1, wherein the pulses comprises strong micro pulses at a very low rate in order to allow a use of a low power supply to provide high voltage applied to a group of emitter.

7. The method of claim 1, wherein a pulse train comprises a plurality of waves, each wave comprising a beginning low amplitude peak, a second high amplitude peak of opposite polarity, and a final low amplitude peak; and wherein said pulses are arranged in bipolar pulse trains defined by a target of charge neutralization.

8. The method of claim 1, further comprising:

providing a simultaneous application of voltage to a linear wire or group of linear emitters in order to reduce an ion density variation effect between points, and allow an even ion balance distribution along a length of the emitter.

9. The method of claim 1, further comprising:

using a microcontroller for controlling and adjusting parameters of pulses or parameters of the pulse train and for controlling and adjusting an air flow to the target.

10. The method of claim 1, further comprising:

using dual ion emitters generating opposite polarity voltages and thereby reducing a radiated electrical field.

11. The method of claim 1, further comprising:

using an AC pulsed high voltage source to generate the bipolar ions.

12. An apparatus for generating bipolar ions in a corona discharge between an emitter and a reference electrode, the apparatus comprising:

a pulse drive circuit configured to generate short duration and sharp micro pulses;

wherein each of the micro pulses comprises a positive voltage portion and a negative voltage portion;

wherein said micro pulses are predominantly asymmetric in magnitude and amplitude of positive and negative voltages; and wherein the magnitude of at least one polarity voltage exceeds the corona threshold.

13. The apparatus of claim 12, wherein a pulse duration of the micro pulses is in nanosecond range such that an applied power is sufficient for corona discharge to generate positive and negative ions.

14. The apparatus of claim 13, wherein the micro pulses are arranged in a pulse train with a duty factor as low as approximately 0.1% such that power applied to said emitter is sufficient for corona discharge to generate positive and negative ions while reducing a buildup of particles on emitter points or wire electrodes and minimizing a contamination associated with corona discharge particle emission from an ionizer and generating minimum ozone and nitrogen oxide.

15. The apparatus of claim 12 wherein the pulses comprise strong ionizing pulses of at least approximately 1000 Volts above an ionizing threshold at a very slow rate, such as approximately 250 Hertz instead of the usual approximately 50,000 to 70,000 Hertz, thus producing ions with low ozone.

16. The apparatus of claim 12, wherein the drive circuit is configured to maintain a reasonably close to zero ions stream balance by varying said number of pulses in at least one polarity pulse train.

17. The apparatus of claim 12, wherein the pulses comprises strong micro pulses at a very low rate in order to allow a use of a low power supply to provide high voltage applied to a group of emitter.

18. The apparatus of claim 12, wherein a pulse train comprises a plurality of waves, each wave comprising a beginning low amplitude peak, a second high amplitude peak of opposite polarity, and a final low amplitude peak; and wherein said pulse drive circuit is configured to generate a variable number, duration, rate and amplitude of sharp bipolar pulses defined by a charge neutralization target.

19. The apparatus of claim 12, wherein the drive circuit is configured to provide a simultaneous application of voltage to a linear wire or group of linear emitters in order to reduce an ion density variation effect between points, and allow an even ion balance distribution along a length of the emitter.

20. The apparatus of claim 12, further comprising:

a microcontroller configured to control and to adjust parameters of pulses or parameters of the pulse train and configured to control and adjust an air flow to the target.

21. The apparatus of claim 12, wherein the emitter further comprising:

dual ion emitters configured to generate opposite polarity voltages and thereby reduce a radiated electrical field.

22. The apparatus of claim 12, wherein the pulse drive circuit includes an AC pulsed high voltage source used to generate the bipolar ions.

* * * * *